US006369504B1

(12) United States Patent
Itaya et al.

(10) Patent No.: US 6,369,504 B1
(45) Date of Patent: Apr. 9, 2002

(54) LOW PRESSURE MERCURY VAPOR DISCHARGE LAMP

(75) Inventors: Kenji Itaya; Takeshi Matsumura, both of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/425,269

(22) Filed: Oct. 22, 1999

(30) Foreign Application Priority Data

Oct. 28, 1998 (JP) ..... 10-306589

(51) Int. Cl.[7] ..... H01J 1/62

(52) U.S. Cl. ..... 313/493; 313/43; 313/492; 313/634

(58) Field of Search ..... 313/318.02, 493, 313/216, 477 HC; 439/442, 395, 421, 443, 229; 362/373, 260, 264

(56) References Cited

U.S. PATENT DOCUMENTS 4,283,217 A * 8/1981 Kawamura ..... 313/182
6,011,347 A * 9/1987 Wittmann ..... 313/318
5,691,598 A * 11/1997 Belle et al. ..... 313/493
6,031,324 A * 11/1999 Itaya et al. ..... 313/37

FOREIGN PATENT DOCUMENTS

JP 52-134273 * 11/1977 ..... 61/36
JP 10-188906 * 7/1998 ..... H01J/5/50

* cited by examiner

*Primary Examiner*—Vip Patel
*Assistant Examiner*—Ken A Berck
(74) *Attorney, Agent, or Firm*—Merchant & Gould PC

(57) ABSTRACT

A low pressure mercury vapor discharge lamp including a discharge tube filled with rare gas and mercury, a base provided at the both ends of the discharge tube and surrounding an electrode sealing portion, and a caulking terminal planted in the base and having a tip inside the base, wherein the base includes electric wiring and at least one of the electric wiring is connected to the caulking terminal to provide an electric connection inside the base. Thus, the position of the caulking terminal is fixed and the automation in the caulking connecting process is realized. Furthermore, after caulking connection, adhesives for adhering the caulking terminal to the inside of the base are not required, thus improving the operation property and productivity by reducing the number of steps and the material cost.

7 Claims, 6 Drawing Sheets

LOW PRESSURE MERCURY VAPOR DISCHARGE LAMP

FIELD OF THE INVENTION

The present invention relates to a low pressure mercury vapor discharge lamp including a discharge tube having a base surrounding an electrode sealing portion at the both ends of the discharge tube.

BACKGROUND OF THE INVENTION

Hitherto, it is known that when a low pressure mercury vapor discharge lamp, for example, a fluorescent lamp, reaches the end of the lifetime, a temperature of an electrode sealing portion of the end of the discharge tube extremely increases. In order to prevent the temperature from extremely increasing at the end of the lifetime and to secure the safety at the end of the lifetime, it has been proposed that a thermal fuse provided in the vicinity of the end of the discharge tube is fused by heat at the end of the discharge tube, thereby interrupting a lighting circuit.

In the above-mentioned fluorescent lamp, rare gas and mercury are filled in the discharge tube. The both ends of the discharge tube are provided with an electrode sealing portion for holding an electrode. The electrode sealing portion is surrounded by a base. Inside the base and in the vicinity of the electrode sealing portion, a temperature protecting element is provided. The temperature protecting element is sensitive to the temperature rise of the electrode sealing portion at the end of the lifetime so as to produce a state in which electric current is interrupted.

The temperature protecting element is connected to at least one lead wire outside the electrode in series. The lead wire outside the electrode is connected to the temperature protecting element by caulking connection with the use of caulking components, or connected by soldering, and the like, after connection as a stranded wire.

In order to prevent the connecting part from short circuiting the other lead wire outside the electrode, the connecting part has a structure in which the caulking connection part is shielded with an insulating member, or a structure in which the caulking connection part is fixed to the inside of the base with a silicon resin member or adhesives.

Furthermore, the lead wire outside the electrode and the base lead terminal are connected to each other at the tip of the base lead terminal of the outside of the base by a soldering process, a melting process or a caulking process.

However, with the above-mentioned conventional fluorescent lamp, the operation efficiency in the process of connecting the lead wire outside the electrode and the temperature protecting element is bad and the process requires many steps and the high material cost. Therefore, the productivity is extremely bad.

Furthermore, in the above-mentioned fluorescent lamp, the connection between the lead wire outside the electrode and the temperature protecting element is performed inside the base, while the connection between the lead wire outside the electrode and the base lead terminal is performed outside the base. Consequently, the operation efficiency becomes worse, thus deteriorating the productivity.

SUMMARY OF THE INVENTION

It is an object of the present invention to provide a low pressure mercury vapor discharge lamp capable of radically improving the productivity by improving the operation efficiency and reducing the number of steps and the material cost.

In order to achieve the above-mentioned object, a low pressure mercury vapor discharge lamp of the present invention includes a discharge tube filled with rare gas and mercury, a base provided at the both ends of the discharge tube and surrounding an electrode sealing portion and a caulking terminal planted in the base and having a tip inside the base, wherein the base includes electric wiring and at least one of the electric wiring is connected to the caulking terminal to provide an electric connection inside the base. According to the above-mentioned low pressure mercury vapor discharge lamp, since the caulking terminal is planted and integrated into the base and the position of the caulking terminal is fixed, the caulking connection process can be automated. Furthermore, after the caulking connection, adhesives for attaching the caulking terminal to the inside of the base are not required, thus improving the operation efficiency and the productivity by reducing the number of steps and the material cost.

It is preferable that the above-mentioned low pressure vapor discharge lamp further includes a temperature protecting element in the base, wherein the temperature protecting element is caulking-connected to at least one lead wire outside the electrode by the caulking terminal.

Furthermore, it is preferable that the caulking terminal has one end projecting outside the base and another end projecting inside the base and includes at least one base lead terminal provided at the base that performs the caulking connection at the another end. According to the above-mentioned low pressure vapor discharge lamp, all the connecting operations can be performed only inside the base. Consequently, the number of the operation steps further can be reduced, and thus the operation efficiency can be improved.

Furthermore, it is preferable that a slit is provided at the tip of the caulking terminal and the caulking connection is performed by inserting the electric wiring into the slit.

Furthermore, it is preferable that the number of the caulking connection terminals is more than one and the direction in which the slit of each connection terminal is cut out is the same. According to the above-mentioned low pressure mercury vapor discharge lamp, since the directions of the slits for caulking connection are the same, the operation efficiency for setting lead wires in the caulking connecting process can be enhanced. Furthermore, since it is possible to fix the direction of caulking by the caulking equipment, the operation efficiency of the caulking process can be improved and the quality of the caulking connection can be stabilized.

Furthermore, it is preferable that the number of the base lead terminals is more than one and the position of the tip inside the base is almost the same in the height direction. According to the above-mentioned low pressure mercury vapor discharge lamp, since the height of the caulking connecting part can be fixed as constant, the operation efficiency of the caulking connection process further can be improved and the quality of the caulking connection can be stabilized.

Furthermore, it is preferable that a discrimination mark is formed on the base lead terminal and outside the base. According to the above-mentioned low pressure vapor discharge lamp, when the base lead terminal is planted in the base, the direction of the slits can be discriminated and controlled even from the outside of the base by using the discrimination mark. Therefore, the control of the direction of the slits can be controlled securely, thus stabilizing the quality of the caulking connection.

Furthermore, it is preferable that the discrimination mark has a convex shape or a concave shape.

DETAILED DESCRIPTION OF THE INVENTION

Hereinafter, the present invention will be described by way of one embodiment with reference to drawings.

Figure 1:
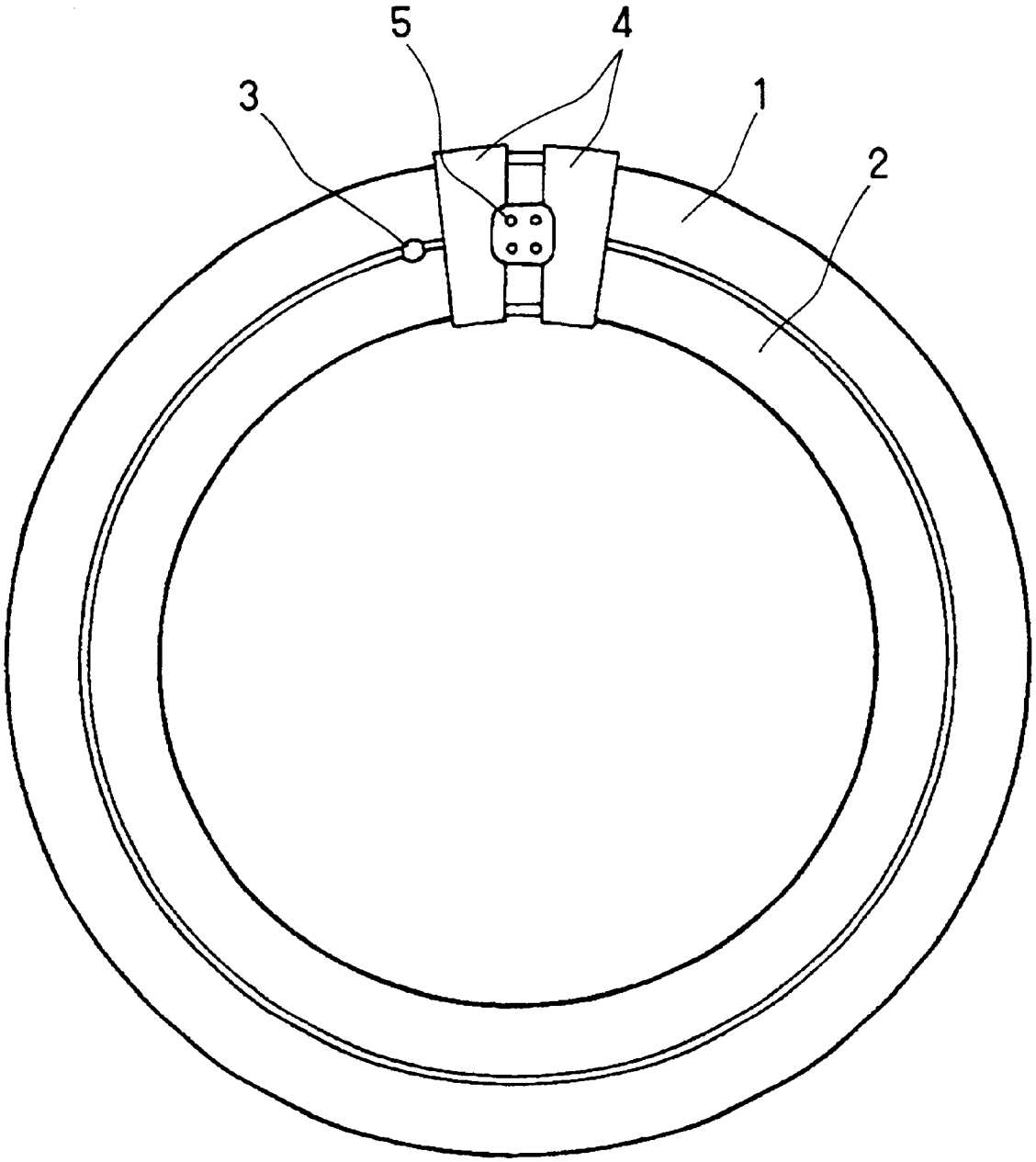
FIG. 1 is a plan view showing a low pressure mercury discharge lamp in one embodiment according to the present invention.

FIG. 1 is a plan view showing a low pressure mercury discharge lamp in one embodiment according to the present invention. As shown in FIG. 1, two circular discharge tubes 1 and 2 made of glass and having different diameters are arranged in approximately the same plane and in an approximately concentric circular relationship.

A circular discharge tube 1 and a circular discharge tube 2 are connected to each other by a bridge connection part 3 in the vicinity of one of the ends of the circular discharge lamps 1 and 2, whereby one discharge path is provided inside the circular discharge tubes 1 and 2.

On the inner surface of the circular discharge tubes 1 and 2, a rare earth fluorescent substance (not shown) is coated. Inside the tube, mercury and rare gas such as argon, neon, etc. as a starting auxiliary gas in an amount of 200 to 500 (Pa) are filled. Moreover, as mercury, an amalgam alloy of zinc-mercury, etc. may be used.

The both ends of the circular discharge tubes 1 and 2 are surrounded by two-split base 4 formed of resin such as polyethylene terephthalate (PET), polybutylene terephthalate (PBT), or the like.

Figure 3:
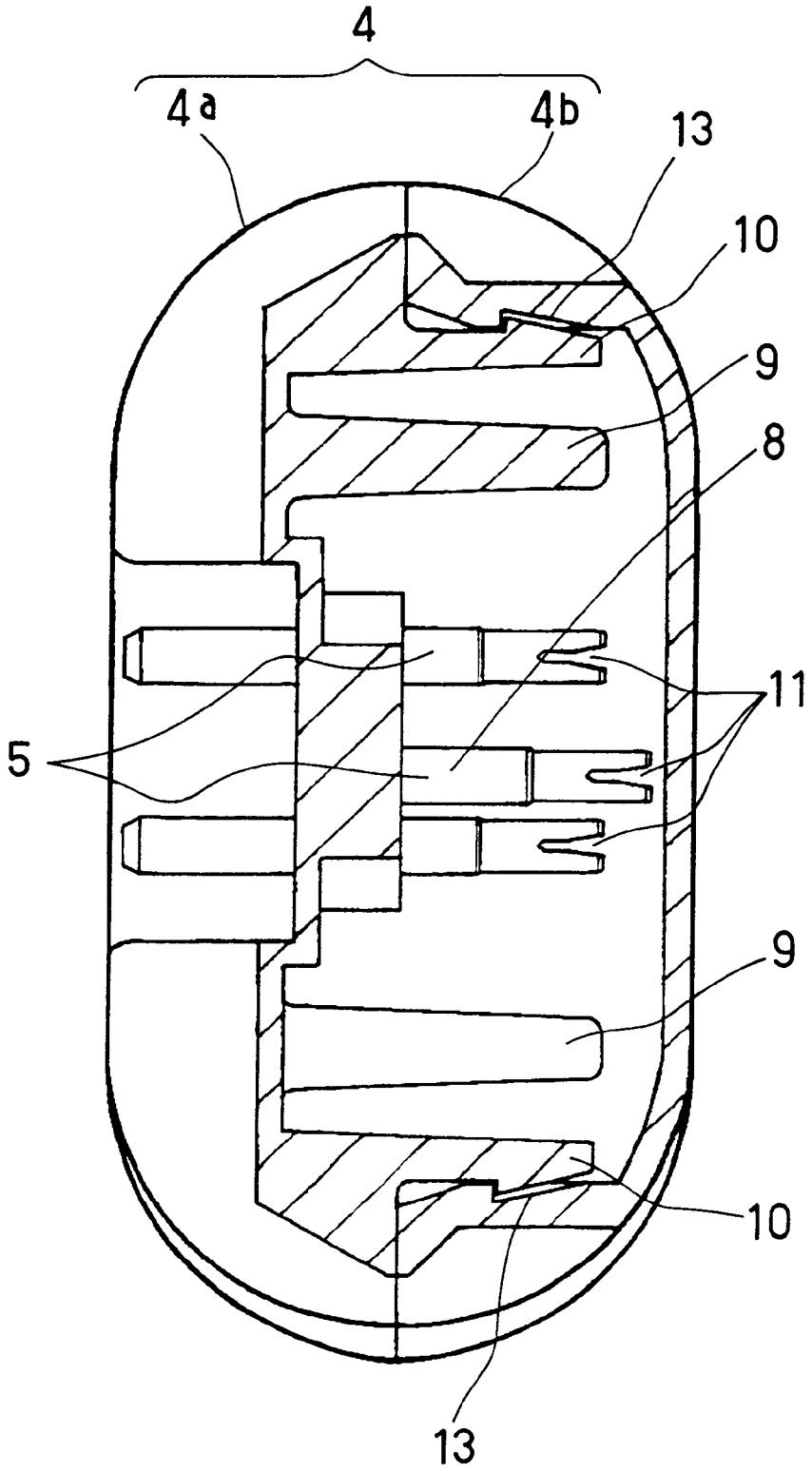
FIG. 3 is a cross-sectional view showing a base of a low pressure mercury discharge lamp in one embodiment according to the present invention.

As shown in FIG. 3, the base 4 includes a catching base 4*a* and a lid base 4*b*. On an inner wall of the both sides of the lid base 4*b*, a latching portion 13 is provided at the position opposing to a catching claw 10 of the catching base 4*a*. Consequently, the catching claw 10 and the latching portion 13 are engaged with each other, thus joining the catching base 4*a* and the lid base 4*b* into one body.

Figure 5:
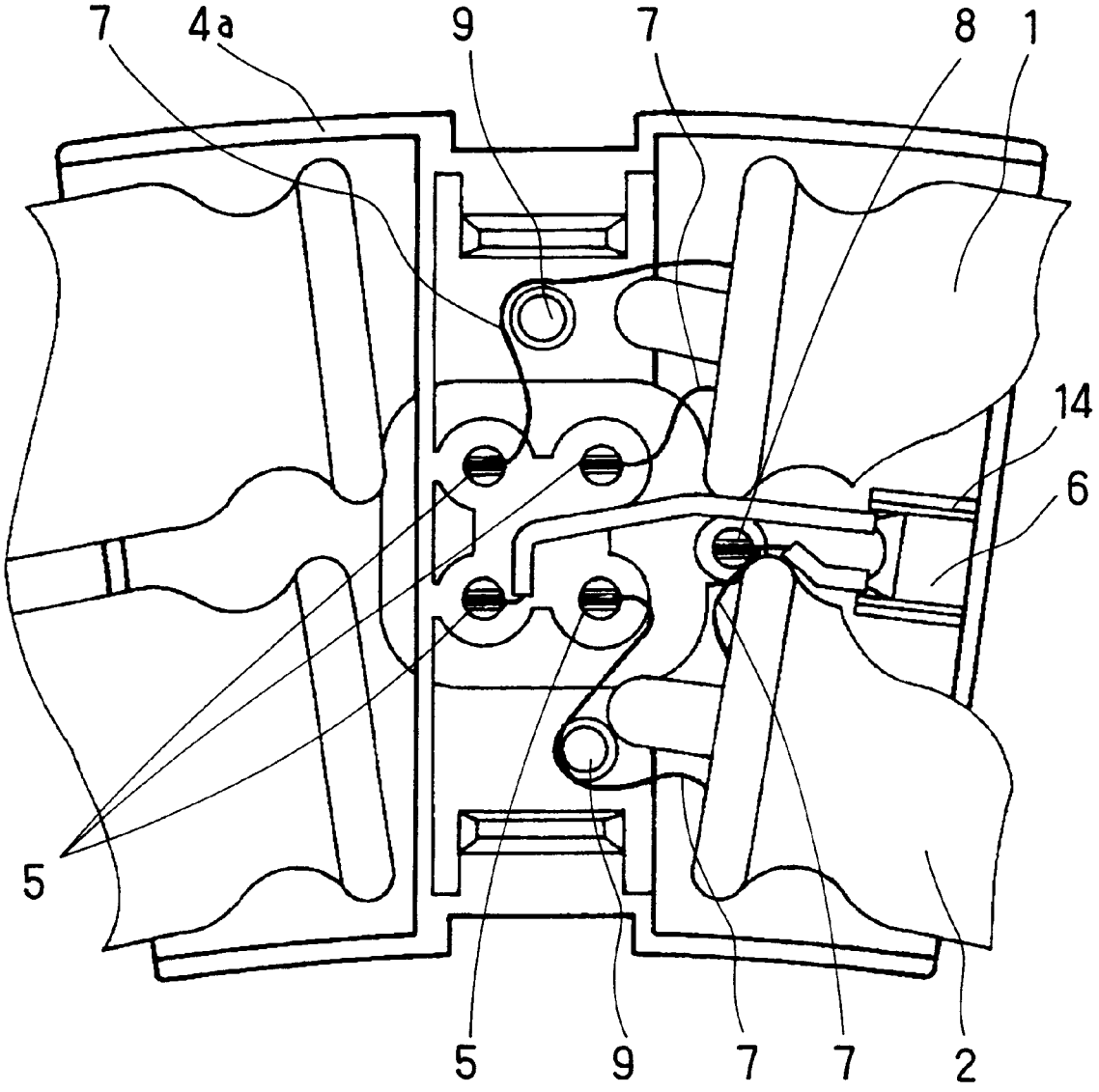
FIG. 5 is a view showing the inner structure of a base in one embodiment according to the present invention.

FIG. 5 is a plan view showing a part of the inner structure of the base 4 in a state in which the lid base 4*b* is removed from the base 4. As shown in FIG. 5, four base lead terminals 5, a temperature protecting element 6 and a caulking terminal 8 for connecting the lead wire 7 outside the electrode are planted. These components may be planted at the same time of forming the catching base 4*a*, or may be press-fitted after the catching base 4*a* is formed, or may be engaged to be fixed. Furthermore, an ejector rod 9 for allowing the lead wire 7 outside the electrode to bypass is provided on the catching base 4*a*.

Figure 4:
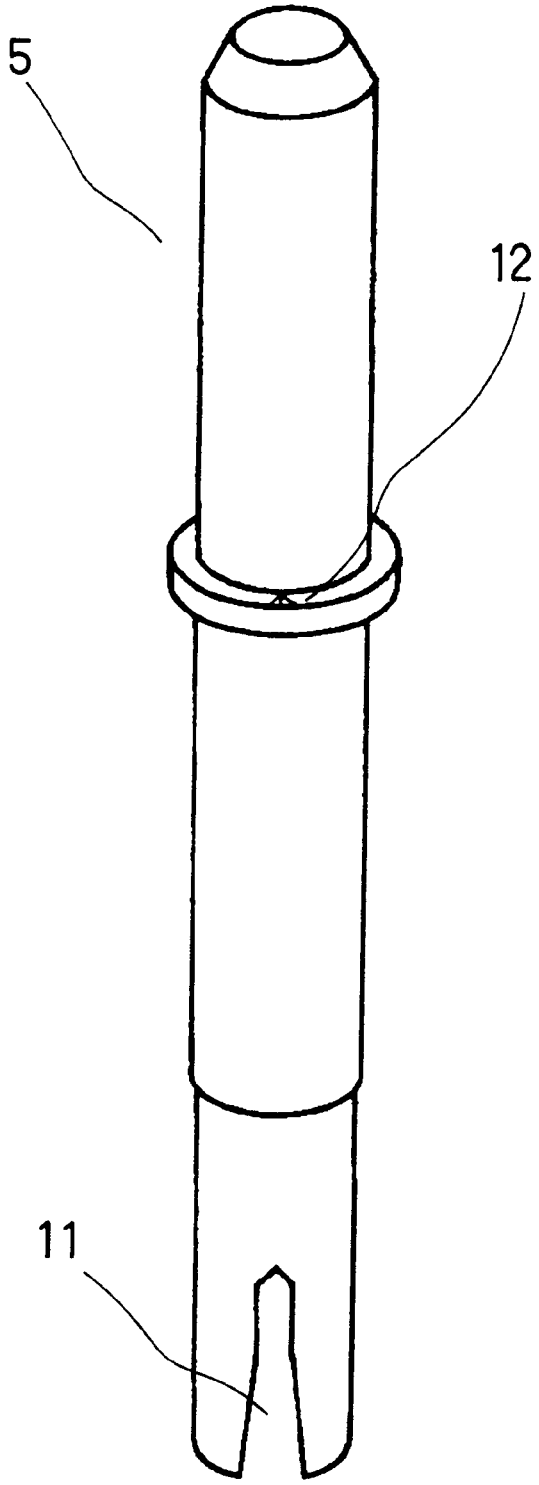
FIG. 4 is a perspective view showing a base lead terminal in one embodiment according to the present invention.

As shown in FIGS. 3 and 4, at the tip of the base lead terminal 5 and the caulking terminal 8 for interconnection, a slit 11 is provided. The tip provided with the slit 11 corresponds to the inside of the base 4. All directions in which the slit 11 is cut out are the same. Thus, the operation efficiency of setting the lead wire in the caulking connecting process can be improved. Furthermore, since the directions of caulking by the caulking equipment can be fixed to be constant, the operation efficiency of the caulking process can be improved. Furthermore, the quality of the caulking connection can be stabilized.

Figure 2:
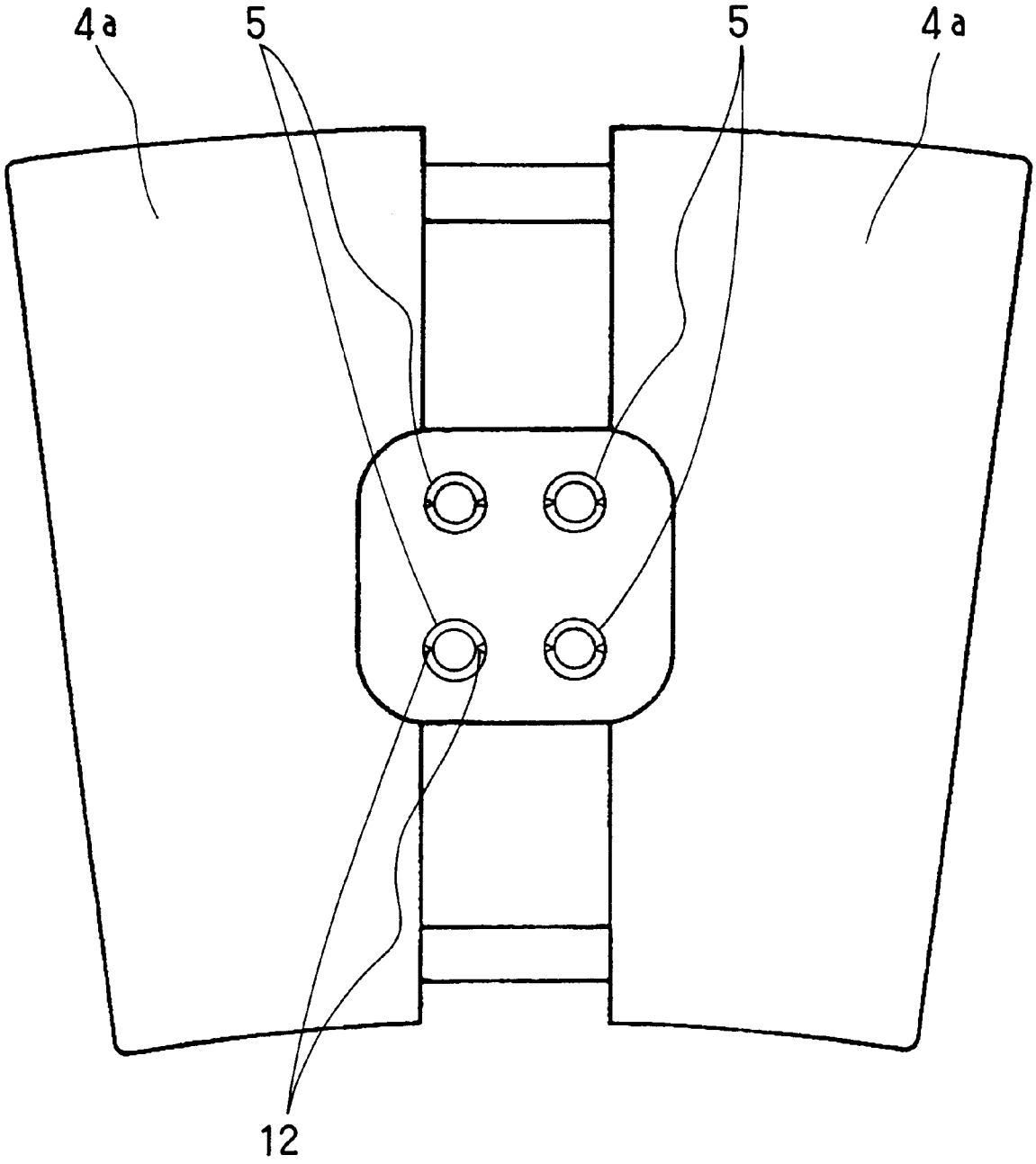
FIG. 2 is a plan view showing a base of a low pressure mercury discharge lamp in one embodiment according to the present invention.

Furthermore, as shown in FIGS. 2 and 4, on the base lead terminal 5 an outside the base, two convex portions 12 serving as a discrimination mark are provided at the position opposing the slit 11 in the circumference direction. In this embodiment, two triangular ribs are provided. Thus, the direction of the slit can be discriminated and controlled by using the convex portion 12 even from the outside of the base 4. Consequently, the slit can be controlled securely and the quality of the caulking connection further can be stabilized. The control of the direction of the slit can be performed by revolving the base lead terminal 5 centered with respect to the axis of the base lead terminal 5. Moreover, the convex-shaped portion is given as an example of the discrimination mark, however, it may be a concave-shaped portion.

Furthermore, as shown in FIG. 3, inside the base 4, the height of the tip of four base lead terminals 5 are adjusted to be almost the same. Thus, the height of the caulking portions is fixed at the constant portion. Therefore, the operation efficiency of the caulking process can be improved and the quality of the caulking connection can be stabilized.

Moreover, in the embodiment, the height of the tip inside the base 4 of the caulking terminal 8 is higher than the tip of the base lead terminal 5. However, preferably, the height of all the tips is the same.

Furthermore, in order to reduce the material cost, the base lead wire terminal 5 and the caulking terminal 8 may share one terminal.

FIG. 5 is a view showing a state of the connection between the lead wire 7 outside the electrode and the base lead terminal 5 and the connection between the temperature protecting element 6, etc. and the caulking terminal 8, etc. in the catching base 4*a*. Hereinafter, these connections will be described.

The connections are carried out as follows. More specifically, the lead wire 7 outside the electrode or the lead wire of the temperature protecting element 6 respectively associated with the slit 11 of the base lead terminal 5 and the caulking terminal 8 are automatically inserted into the slit 11 of the bass lead terminal 5 and the caulking terminal 8.

Figure 6:
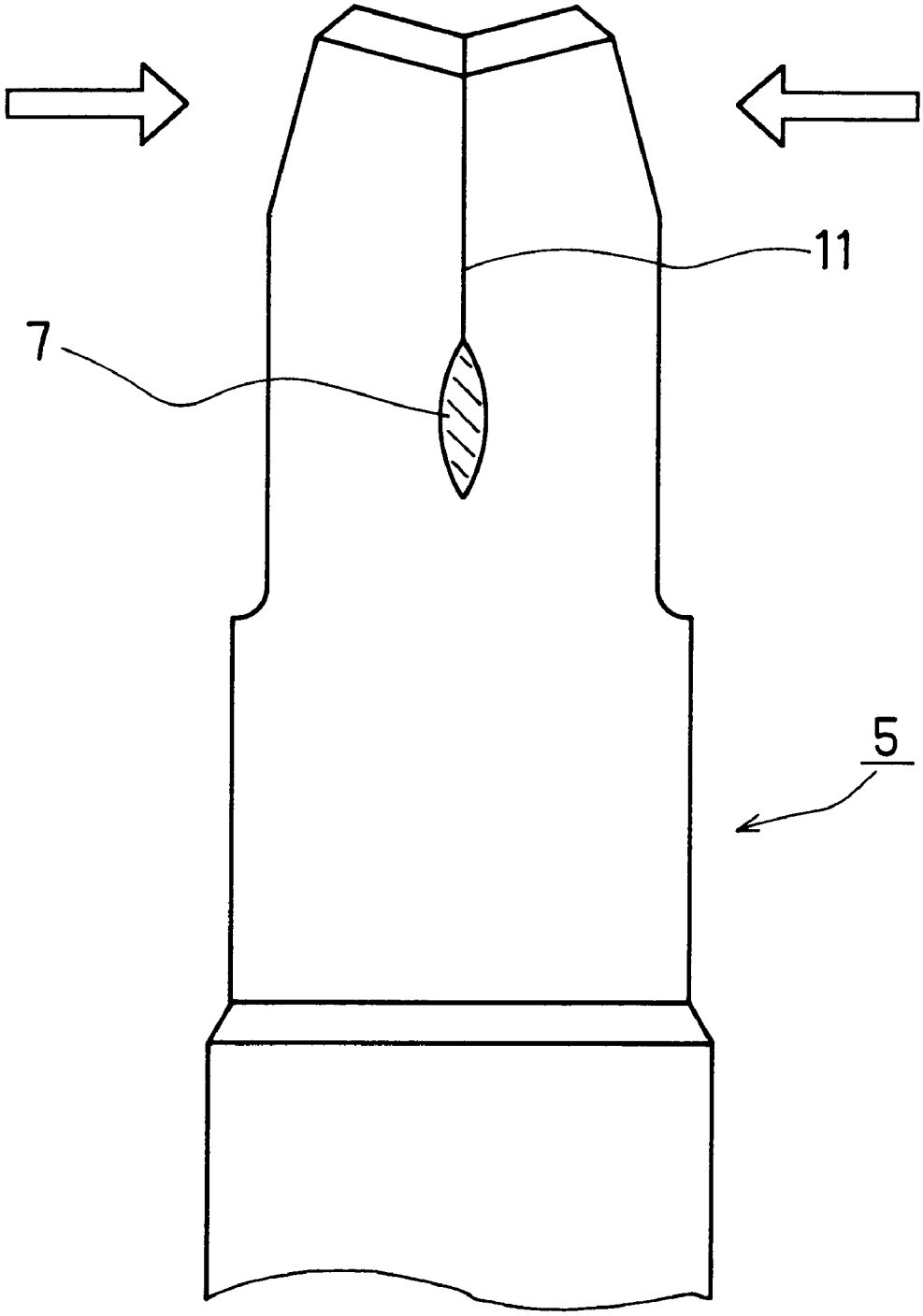
FIG. 6 is a view showing a state in which a caulking connection is performed in one embodiment according to the present invention.

FIG. 6 shows a state in which the lead wire 7 outside the electrode is caulking-connected to the slit 11 of the base lead terminal 5. This caulking connection is performed by inserting the lead wire 7 outside the electrode into the slit 11, and then applying the force in the direction shown by the arrow in FIG. 6.

Then, the caulking process is performed. Next, as shown in FIG. 3, the latching portion 13 of the catching base 4*a* and the catching portion 10 of the id base 4*b* are automatically engaged with each other, to thus join the catching base 4*a* and the lid base 4*b*.

If necessary, an insulating coat is used for a part of the lead wire of the temperature protecting element 6 so as to prevent the occurrence of short circuit inside the base 4. Furthermore, the temperature protecting element housing 14 having partition is formed at the predetermined portion of the catching base 4*a*. The temperature protecting element 6 may be positioned in the above-mentioned housing by a pressing method, or the like.

Furthermore, if necessary, in order to prevent the short circuit caused by the lead wires 7 outside the electrode that are in contact with each other, the lead wire 7 outside the electrode is allowed to bypass by using the ejector rod 9, thereby to secure the insulating distance. Consequently, the safety can be improved.

When a low pressure mercury vapor discharge lamp of 700 W having a maximum circular external diameter of 296 mm and a diameter of discharge tube of 20 mm is manufactured, the whole process including attaching a base can automatically can be carried out. As compared with the process of the prior art, the cost radically can be reduced and the productivity can be improved.

The invention may be embodied in other specific forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A low pressure mercury vapor discharge lamp comprising a discharge tube filled with rare gas and mercury, a base provided at the both ends of said discharge tube and surrounding an electrode sealing portion, and a caulking terminal planted in said base and having a tip inside said base, wherein said base includes electric wiring and at least one electric wiring is connected to said caulking terminal to provide an electric connection inside said base, and further includes a temperature protecting element and said temperature protecting element is caulking-connected to at least one lead wire outside the electrode by said caulking terminal.

2. The low pressure mercury vapor discharge lamp according to claim 1, wherein said caulking terminal comprises at least one base lead terminal provided at said base, having one end projecting outside said base and another end projecting inside said base and performing said caulking connection at said another end.

3. The low pressure mercury vapor discharge lamp according to claim 1, wherein a slit is provided at the tip of said caulking terminal and said caulking connection is performed by inserting the electric wiring into said slit.

4. The low pressure mercury vapor discharge lamp according to claim 3, wherein the number of said caulking connection terminals is more than one and the direction in which said slit of each connection terminal is cut out is the same.

5. The low pressure mercury vapor discharge lamp according to claim 2, wherein the number of said base lead terminal is more than one and the position of the tip inside said base is substantially the same in the height direction.

6. A low pressure mercury vapor discharge lamp, comprising a discharge tube filled with rare gas and mercury, a base provided at the both ends of said discharge tube and surrounding an electrode sealing portion, and a caulking terminal planted in said base and having a tip inside said base, wherein said base includes electric wiring and at least one electric wiring is connected to said caulking terminal to provide an electric connection inside said base, said caulking terminal comprises at least one base lead terminal provided at said base, having one end projecting outside said base and another end projecting inside said base and performing said caulking connection at said another end; and a discrimination mark is formed on said base lead terminal and outside the base.

7. The low pressure mercury vapor discharge lamp according to claim 6, wherein said discrimination mark has a convex shape or a concave shape.

* * * * *